US008074564B2

(12) United States Patent
Kowlessar

(10) Patent No.: US 8,074,564 B2
(45) Date of Patent: Dec. 13, 2011

(54) SIP AND DIP COOKIE APPARATUS

(76) Inventor: David S. Kowlessar, Alexandria, VA (US)

( * ) Notice: Subject to any disclaimer, the term of this patent is extended or adjusted under 35 U.S.C. 154(b) by 484 days.

(21) Appl. No.: 12/362,477

(22) Filed: Jan. 29, 2009

(65) Prior Publication Data

US 2009/0133586 A1 May 28, 2009

Related U.S. Application Data

(63) Continuation-in-part of application No. 12/014,176, filed on Jan. 15, 2008.

(60) Provisional application No. 60/968,552, filed on Aug. 28, 2007.

(51) Int. Cl.
*B65D 8/18* (2006.01)
*A47G 21/18* (2006.01)

(52) U.S. Cl. ..... 99/426; 220/4.25; 220/4.22; 220/705; 239/33

(58) Field of Classification Search ..... 99/426, 99/440, 494; 239/16, 24–33; 220/4.22, 4.25, 220/4.24, 705; 248/324, 326, 333; 426/85, 426/115, 134
See application file for complete search history.

(56) References Cited

U.S. PATENT DOCUMENTS

| | | | | |
|---|---|---|---|---|
| 3,759,163 | A * | 9/1973 | Walker | 99/336 |
| 4,211,024 | A | 7/1980 | Nickell | |
| D297,202 | S | 8/1988 | Zumwalt | |
| 5,584,434 | A * | 12/1996 | Lipson | 239/33 |
| 6,056,206 | A | 5/2000 | Whiton | |
| 6,503,222 | B2 * | 1/2003 | Lo | 604/77 |
| 6,565,899 | B1 | 5/2003 | Cecere | |
| D519,004 | S | 4/2006 | Archer | |
| 7,090,269 | B2 | 8/2006 | Kelsey | |
| D579,736 | S | 11/2008 | Cotter et al. | |
| 7,552,674 | B1 * | 6/2009 | Cotter | 99/426 |
| 2001/0054618 | A1 | 12/2001 | Ferrari | |
| 2004/0084912 | A1 | 5/2004 | Palmieri | |
| 2004/0244596 | A1 | 12/2004 | Ogline | |
| 2005/0109222 | A1 | 5/2005 | Swenson | |
| 2006/0096872 | A1 | 5/2006 | Oakes | |
| 2007/0095686 | A1 | 5/2007 | DeGroote | |

* cited by examiner

*Primary Examiner* — Kien Nguyen
(74) *Attorney, Agent, or Firm* — Hoang Steve Ngo

(57) ABSTRACT

A sip and dip cookie apparatus. The sip and cookie dipper apparatus is made up of an upper elongated portion configured to hold a straw, a lower portion configured to hold a cookie, and a cookie cover. The upper elongated portion and lower portion are integrally connected.

2 Claims, 19 Drawing Sheets

| TABLE 1 | |
|---|---|
| *C* | cookie |
| *S* | straw |
| *LS* | left-side of sip and dip cookie apparatus 100 |
| *RS* | right-side of sip and dip cookie apparatus 100 |
| 100 | sip and dip cookie apparatus 100 |
| 120 | upper elongated portion 120 |
| 140 | lower portion 140 |
| 160 | cookie cover 160 |
| 180 | first end 180 of cookie cover 160 |
| 185 | first protrusion 185 at first end 180 |
| 200 | second end 200 of cookie cover 160 |
| 205 | Second protrusion 205 at second end 200 |
| 220 | internal void 220 located inside the upper elongated portion 120 |
| 240 | at least one straw guide member 240 |
| 260 | straw guide aperture 260 |
| 280 | bottom end 280 of upper portion 120 |
| 300 | top end 300 of upper portion 120 |
| 320 | top end 300 defines a top aperture 320 |
| 340 | first sidewall 340 of lower portion 140 |
| 360 | second sidewall 360 of lower portion 140 |
| 340i | interior surfaces 340i of first sidewall 340 |
| 360i | interior surfaces 360i of first sidewall 360 |
| 380 | first curved outer periphery 380 |
| 400 | second curved outer periphery 400 |
| 420 | rim 420 |
| 420*ls* | left side 420*ls* of rim 420 |
| 420*rs* | right side 420*rs* of rim 420 |

*Fig. 13A*

| TABLE 1 (continued) | |
|---|---|
| 430 | internal rim surface 430 |
| 430*ls* | left side 430*ls* of internal rim surface 430 |
| 430*rs* | right side 430*rs* of internal rim surface 430 |
| 440 | proximal end 440 of rim 420 |
| 460 | distal end 460 of rim 420 |
| 480 | second internal void 480 |
| 500 | first upper sidewall edge 500 of first sidewall 340 |
| 520 | second upper sidewall edge 520 of second sidewall 360 |
| 540 | cookie access aperture 540 located between first and second upper sidewall edges 500 and 520 |
| 560 | straw exit aperture 560 |
| 570 | first cookie guide member 570 |
| 575 | first cookie guide member 570 defines opposite ends 575 and 577 |
| 577 | first cookie guide member 570 defines opposite ends 575 and 577 |
| 578 | first cookie guide member 570 defines first lower guide surface 578 |
| 580 | second cookie guide member 580 |
| 590 | second cookie guide member 580 defines opposite ends 590 and 595 |
| 595 | second cookie guide member 580 defines opposite ends 590 and 595 |
| 598 | first cookie guide member 570 defines first upper guide surface 598 |
| 600 | second cookie guide member 580 defines second lower guide surface 600 |
| 620 | second cookie guide member 580 defines second upper guide surface 620 |

*Fig. 13B*

| TABLE 1 (continued) | |
|---|---|
| 630 | first cookie guide member 570 and rim 420 define a first cookie guide slot 630 therebetween |
| 630a | gap 630a depicts gap between first cookie guide member 570 and left side 420*ls* of rim 420 proximate to left side 670*ls* of first drain aperture side 670 (see exploded view of Figure 3A), *i.e.,* gap 630a defines the width of the first cookie guide slot 630 next to the left side 670*ls* of first drain aperture side 670 |
| 630b | gap 630b depicts gap between first cookie guide member 570 and left side 420*ls* of rim 420 proximate to left side 680*ls* of second drain aperture side 680 (see exploded view of Figure 3A), *i.e.,* gap 630b defines the width of the first cookie guide slot 630 next to the left side 680*ls* of second drain aperture side 680 |
| 640 | second cookie guide member 580 and rim 420 define a second cookie guide slot 640 therebetween |
| 640a | gap 640a depicts gap between second cookie guide member 580 and right side 420*rs* of rim 420 proximate to right side 670*rs* of first drain aperture side 670 (see exploded view of Figure 3A), *i.e.,* gap 640a defines the width of the second cookie guide slot 640 proximate to the right side 670*ls* of first drain aperture side 670 |
| 640b | gap 640b depicts gap between second cookie guide member 580 and right side 420*rs* of rim 420 proximate to right side 680*rs* of second drain aperture side 680 (see exploded view of Figure 3A), *i.e.,* gap 640b defines the width of the second cookie guide slot 640 next to the right side 680*rs* of second drain aperture side 680 |
| 660 | drain aperture 660 |
| 670 | first drain aperture side 670 of drain aperture 660 |
| 670*ls* | left side 670*ls* of first drain aperture side 670 |
| 670*rs* | right side 670*rs* of first drain aperture side 670 |
| 680 | second drain aperture side 680 of drain aperture 660, wherein the sides 670 and 680 face opposite each other, sides 670 and 680 are transverse with respect to rim 420, side 670 is closer to proximal end 440 of rim 420 than side 680, and side 680 is closer than side 670 to distal end 460 of rim 420 |
| 680*ls* | left side 680*ls* of second drain aperture side 680 |
| 680*rs* | right side 680*rs* of second drain aperture side 680 |
| 700 | optional additional drain aperture 700 |

*Fig. 13C*

SIP AND DIP COOKIE APPARATUS

CROSS-REFERENCE TO RELATED APPLICATIONS

The present application is a continuation-in-part of U.S. Ser. No. 12/014,176, filed Jan. 15, 2008 and U.S. provisional application Ser. No. 60/968,552, filed Aug. 28, 2007. U.S. Ser. No. 12/014,176 and U.S. provisional application Ser. No. 60/968,552 are incorporated herein by reference in their entirety.

STATEMENT REGARDING FEDERALLY SPONSORED RESEARCH OR DEVELOPMENT

Not Applicable.

FIELD OF THE INVENTION

The present invention relates to cookie dippers and more particularly to a sip and dip cookie apparatus designed to work with a straw.

BACKGROUND OF THE INVENTION

Dunking cookies into milk can be a somewhat messy undertaking. The child or adult dunking a cookie into a container such as a tumbler or cup type container filled with milk can easily contact their fingers directly with the milk held in the container. To avoid contact with the milk held in the container the person ("the dunker") doing the dunking is obliged to keep part of the cookie out of the milk. Even when the dunker keeps part of the cookie out of the milk the cookie can fall apart as it absorbs the milk from the container leading to a further mess especially if the dunker then uses his fingers to pick out the remnants of the cookie from the container. Thus, there is a need for a device or apparatus that is easy to use and which allows a dunker to immerse the whole cookie in the milk without risk of loosing the cookie.

SUMMARY OF THE INVENTION

A sip and dip cookie apparatus. The sip and cookie dipper apparatus is made up of an upper elongated portion configured to hold a straw, a lower portion configured to hold a cookie, and a cookie cover. The upper elongated portion and lower portion are integrally connected.

BRIEF DESCRIPTION OF THE DRAWINGS

FIGS. 13A, 13B and 13C show Table 1.

Similar reference characters denote corresponding features consistently throughout the attached drawings.

DETAILED DESCRIPTION OF THE INVENTION

This invention is directed to cookie dippers and more particularly to a sip and cookie dipper apparatus designed to work with a straw. The sip and dip cookie apparatus of the present invention is denoted generally by the numeric label "100". A child or adult can use the sip and dip cookie apparatus 100. The sip and cookie dipper apparatus can be made out of any suitable material such as plastic.

Figure 1:
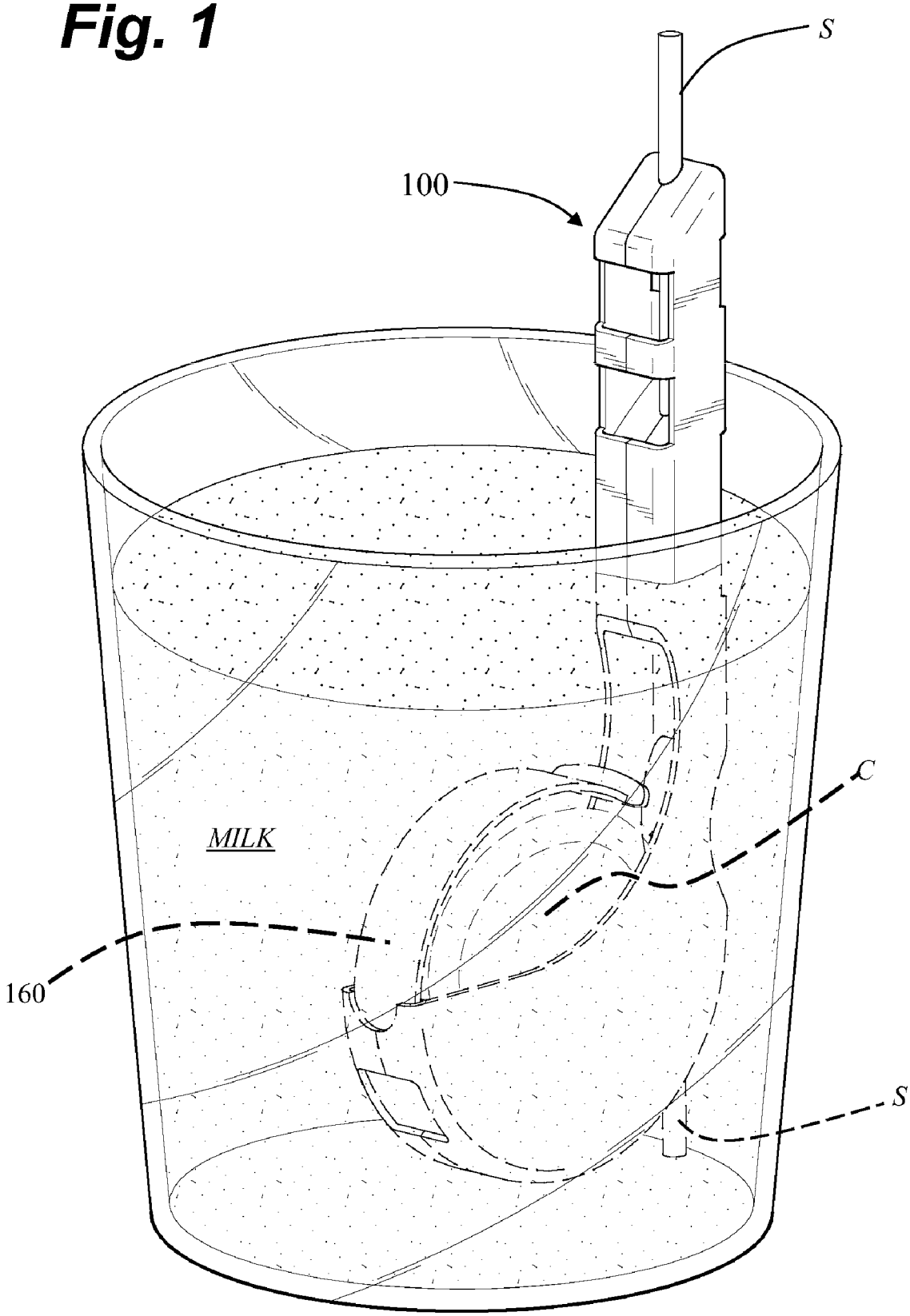
FIG. 1 shows a perspective environmental view of a sip and dip cookie apparatus according to the present invention.

As shown in FIG. 1 the sip and dip cookie apparatus 100 is shown in an upright or vertical orientation. However, it will be appreciated that the sip and dip cookie apparatus 100 can be operated in other orientations. Therefore, terms such as "upper and lower" and "above and below" as used herein are meant in the relative sense and not the absolute sense.

Referring now to the Figures in general with regard to which the meaning of labels and numbers shown in the Figures are described in Table 1 (see FIGS. 13A through 13C). The sip and dip cookie apparatus 100 of the present invention comprises an upper elongated portion 120, a lower portion 140, and a cookie cover 160. The cookie cover 160 has a generally flat and elongated curved shape having opposite first and second ends 180 and 200, respectively.

The upper portion 120 is generally configured to hold a straw S capable of sucking milk. The lower portion 140 is generally configured to hold a cookie C. The upper elongated portion 120 and lower portion 140 are integrally connected. The upper elongated portion 120 defines a first void 220 located inside the upper elongated portion 120. The first void 220 has at least one straw guide member 240 located therein. Each of the at least one straw guide members 240 define a straw guide aperture 260 for the passage of a straw S therethrough. The upper portion 120 further defines bottom and top ends 280 and 300, respectively. The top end 300 defines a top aperture 320 of sufficient diameter to allow passage of a straw S therethrough.

The lower portion 140 comprises first and second opposite facing sidewalls 340 and 360, respectively. The first and second opposite facing sidewalls 340 and 360 are approximately semicircular in shape and face opposite each other, and respectively define first and second curved outer peripheries 380 and 400. The first and second peripheries 380 and 400 are joined by a rim 420 located therebetween. The rim 420 has opposite proximal and distal ends 440 and 460, respectively. The proximal end 440 is integral with the bottom end 280 of the upper elongated portion 120 and vice versa.

The first and second sidewalls 340 and 360 together with the rim 420 of the lower portion 140 collectively define a second internal void 480. The dimensions of the second internal void 480 (e.g., width as defined by rim 420 and overall height of first and second sidewalls 340 and 360) are sufficient to accommodate a selected cookie such as, but not limited to, an Oreo® brand cookie; Oreo® brand cookies are currently manufactured by the Nabisco Division of Kraft Foods. It should be understood that the types of cookie that can be held in the lower portion 140 can vary according to the users taste. For example, the lower portion 140 can be dimensioned to accommodate cookies as shown in, but not limited to, U.S. Design Pat. Nos. D440736 and D297280.

The first and second sidewalls 340 and 360 respectively define first and second upper sidewall edges 500 and 520 and a cookie access aperture 540 therebetween. During typical use of the sip and dip cookie apparatus 100 a user deposits a cookie into the second internal void 480 via cookie access aperture 540, and a straw is disposed through the top aperture 320 and thence through the straw guide aperture 260 and then through straw exit aperture 560 for sucking up milk. The cookie cover 160 is extended over the cookie thereby securing the cookie inside second void 480 allowing the user to dunk the device 100 into milk and later retrieve the cookie by either sucking up all or part of the milk through the straw or by lifting the device 100 out of the milk and retracting the cookie cover 160 to allow the user to remove the milk saturated cookie from the device 100 without any need for the user to dip their fingers into the milk.

Referring now to FIG. 1, which shows a perspective environmental view of the sip and dip cookie apparatus 100, according to the present invention. An explanation of the part numbers shown in FIG. 1 is found in Table 1.

Figure 2:
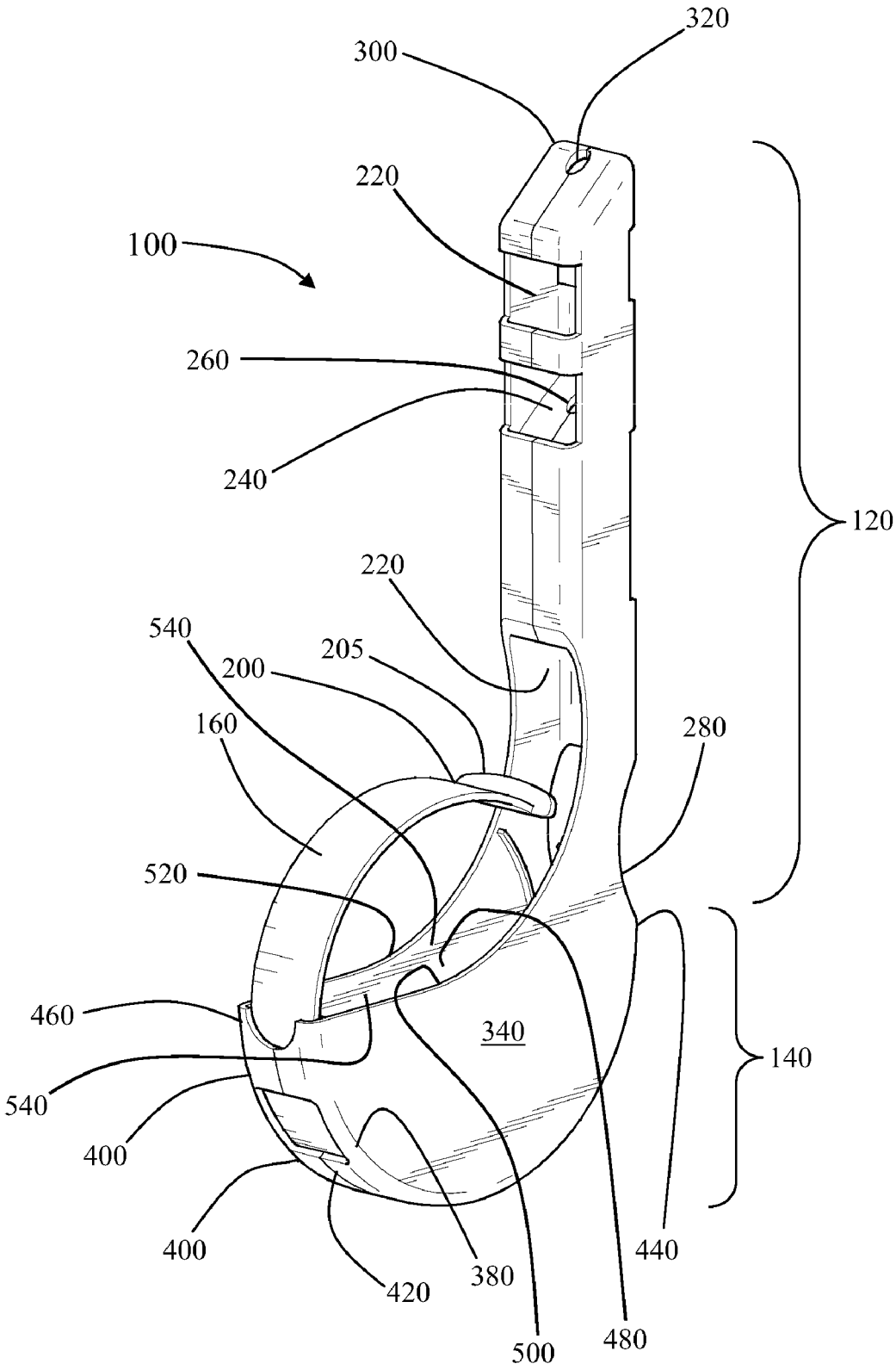
FIG. 2 shows a perspective front view of the sip and dip cookie apparatus shown in FIG. 1.

FIG. 2 shows a perspective front view of the sip and dip cookie apparatus 100 shown in FIG. 1. An explanation of the part numbers shown in FIG. 2 is found in Table 1.

Figure 3:
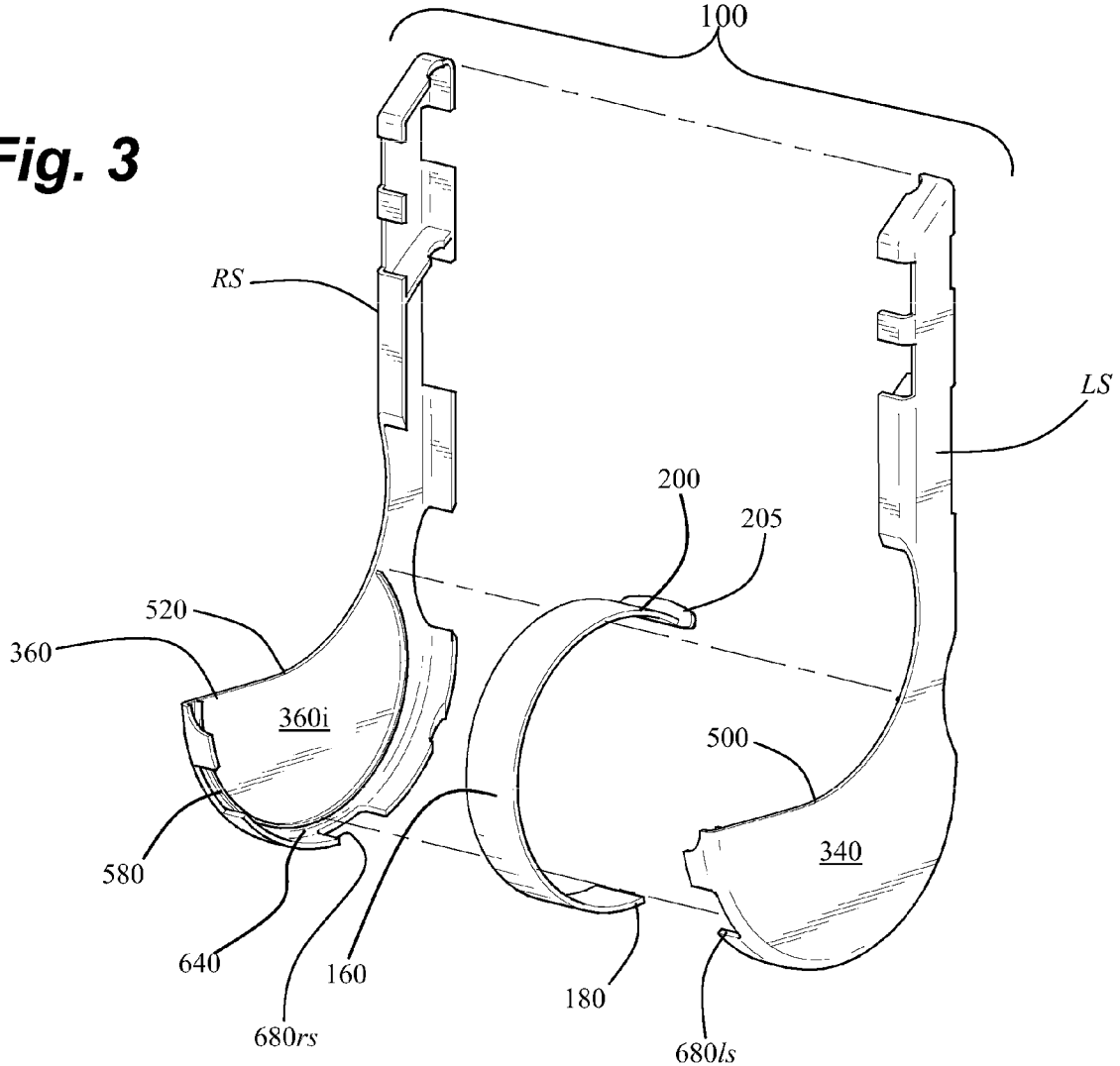
FIGS. 3 and 3A show exploded views of the sip and dip cookie apparatus shown in FIG. 1.
Figure 3A:
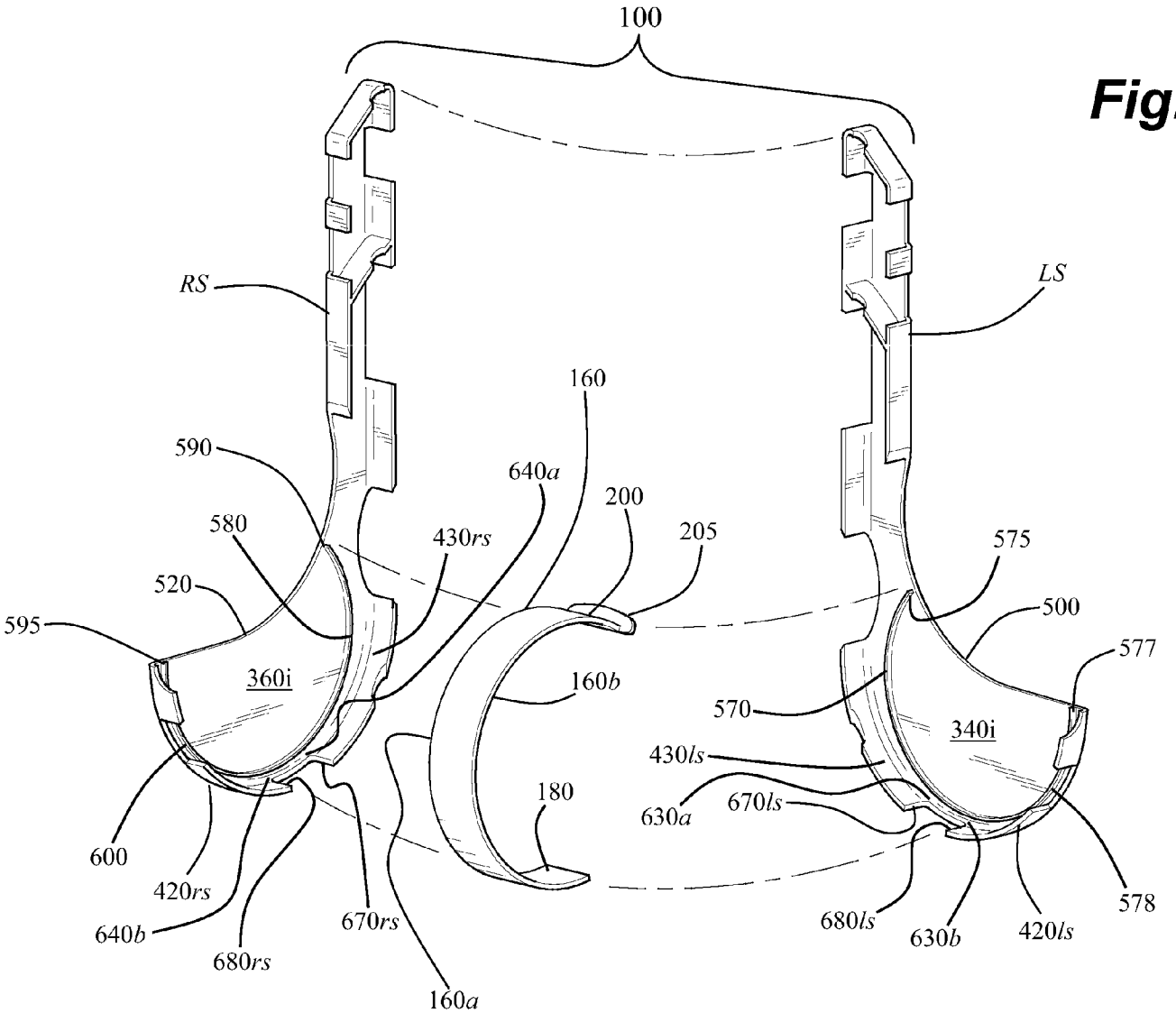

FIGS. 3 and 3A show exploded views of the sip and dip cookie apparatus 100 shown in FIG. 1. The exploded views depicts three components that make up the sip and dip cookie apparatus 100 of which the left-side (LS) and right-side (RS) parts can be mirror images of each other or unsymmetrical. An explanation of the part numbers shown in FIGS. 3 and 3A are found in Table 1.

Figure 4:
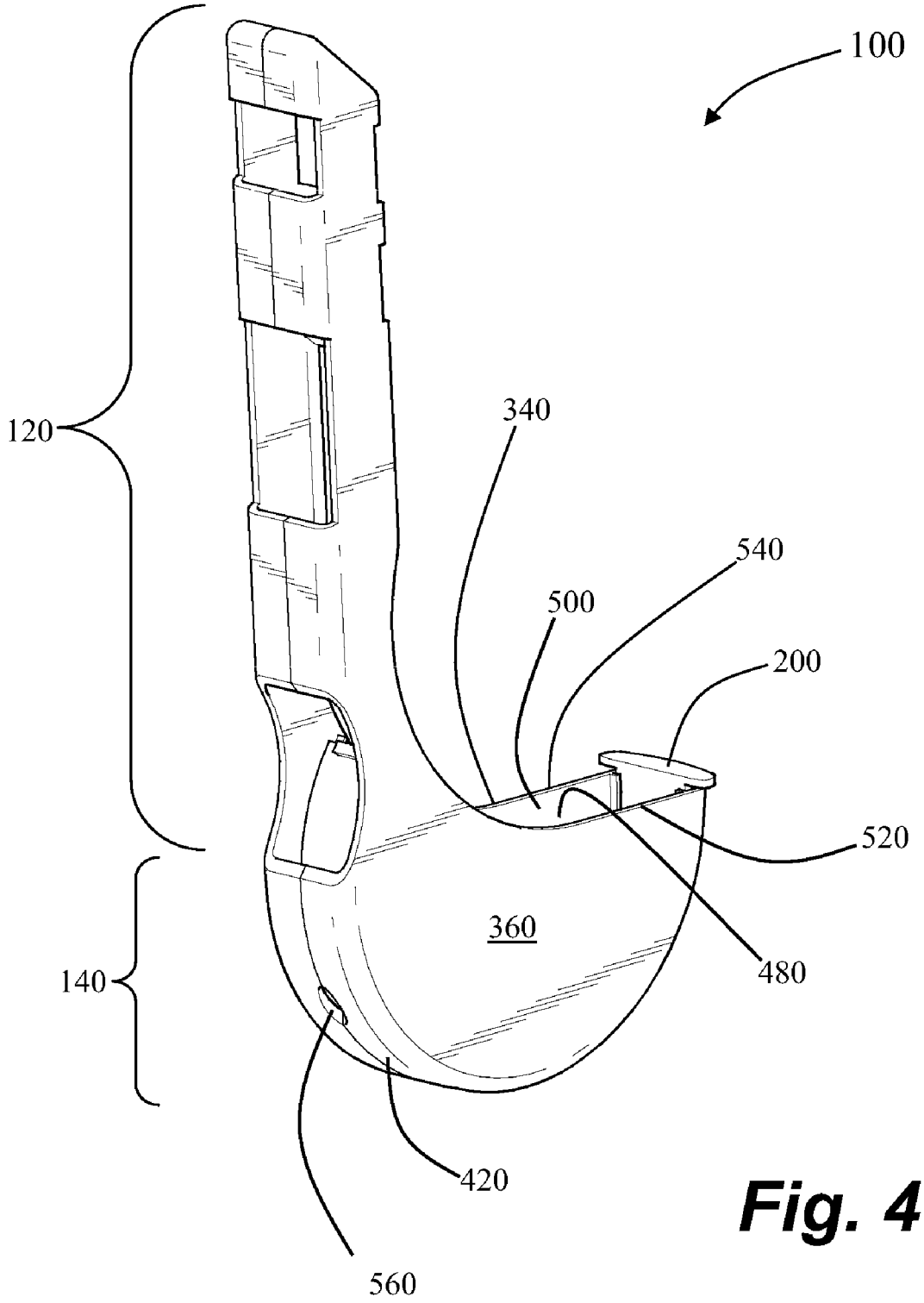
FIG. 4 shows a perspective rear view of the sip and dip cookie apparatus shown in FIG. 1.

FIG. 4 shows a perspective rear view of the sip and dip cookie apparatus 100 shown in FIG. 1. An explanation of the part numbers shown in FIG. 4 is found in Table 1.

Figure 5:
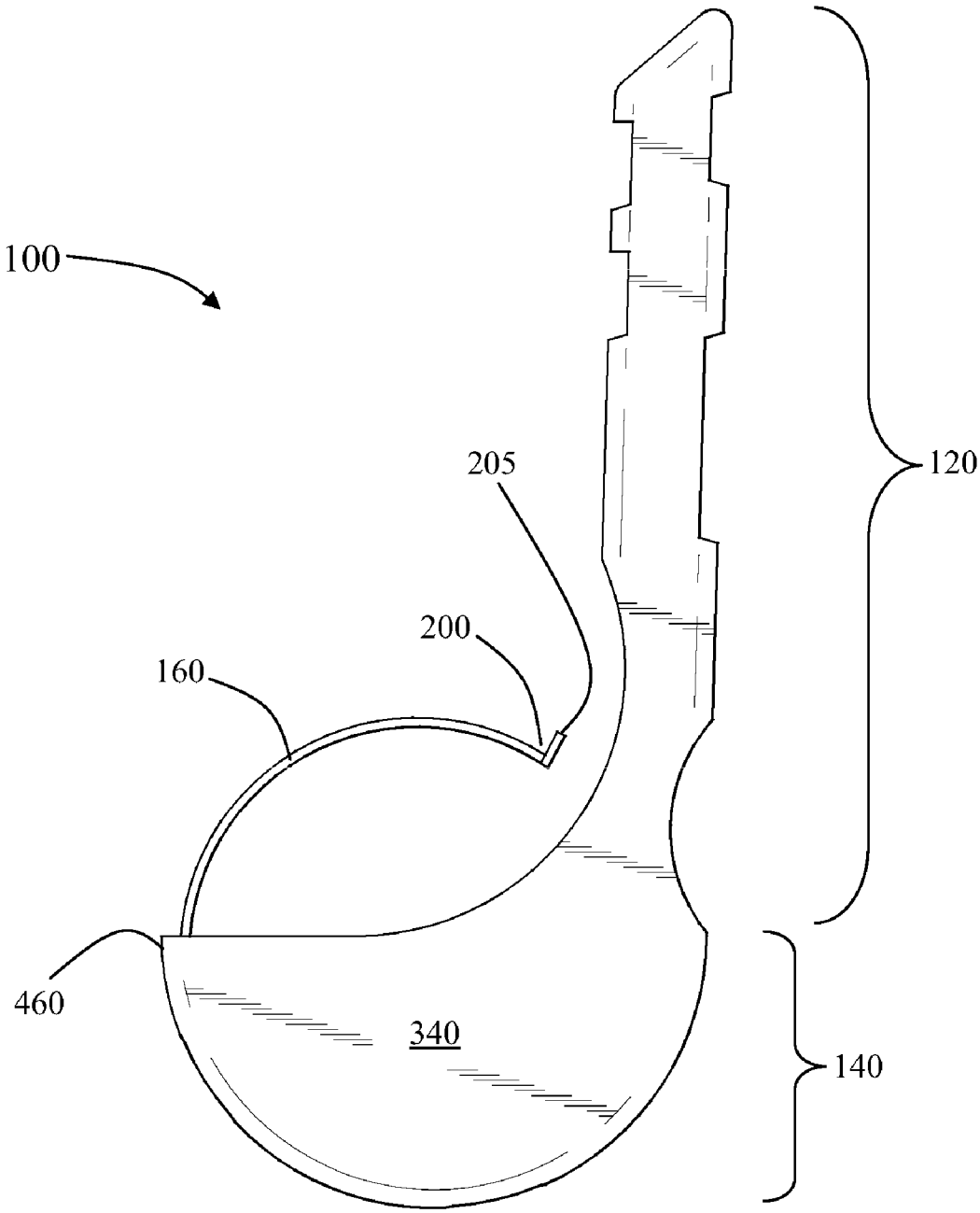
FIG. 5 shows a left side view of the sip and dip cookie apparatus shown in FIG. 1.

FIG. 5 shows a left side view of the sip and dip cookie apparatus 100 shown in FIG. 1. An explanation of the part numbers shown in FIG. 4 is found in Table 1.

Figure 6:
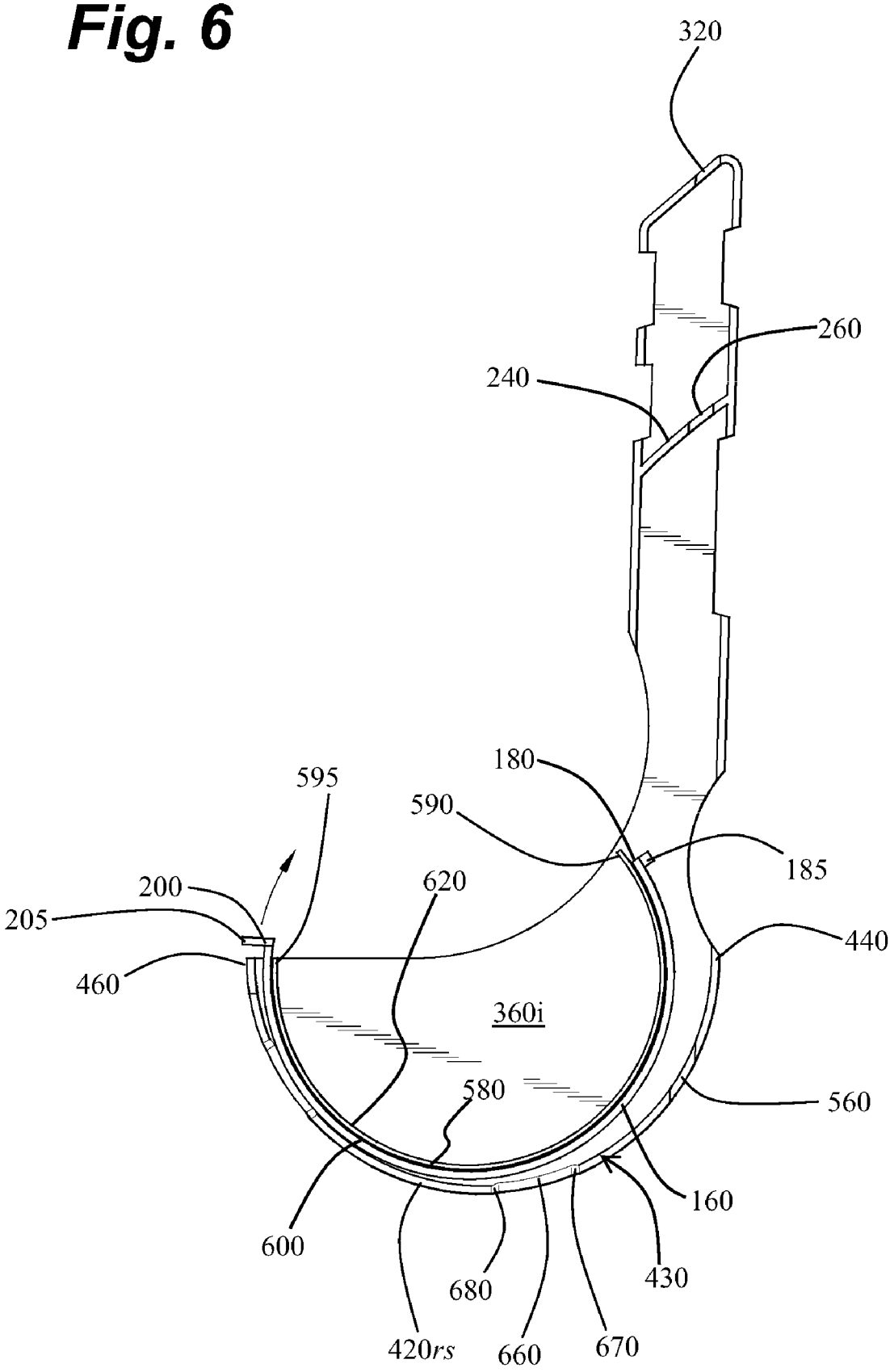
FIG. 6 shows a partially cutaway view of the sip and dip cookie apparatus with a cookie cover in a retracted position according to the present invention.
Figure 6A:
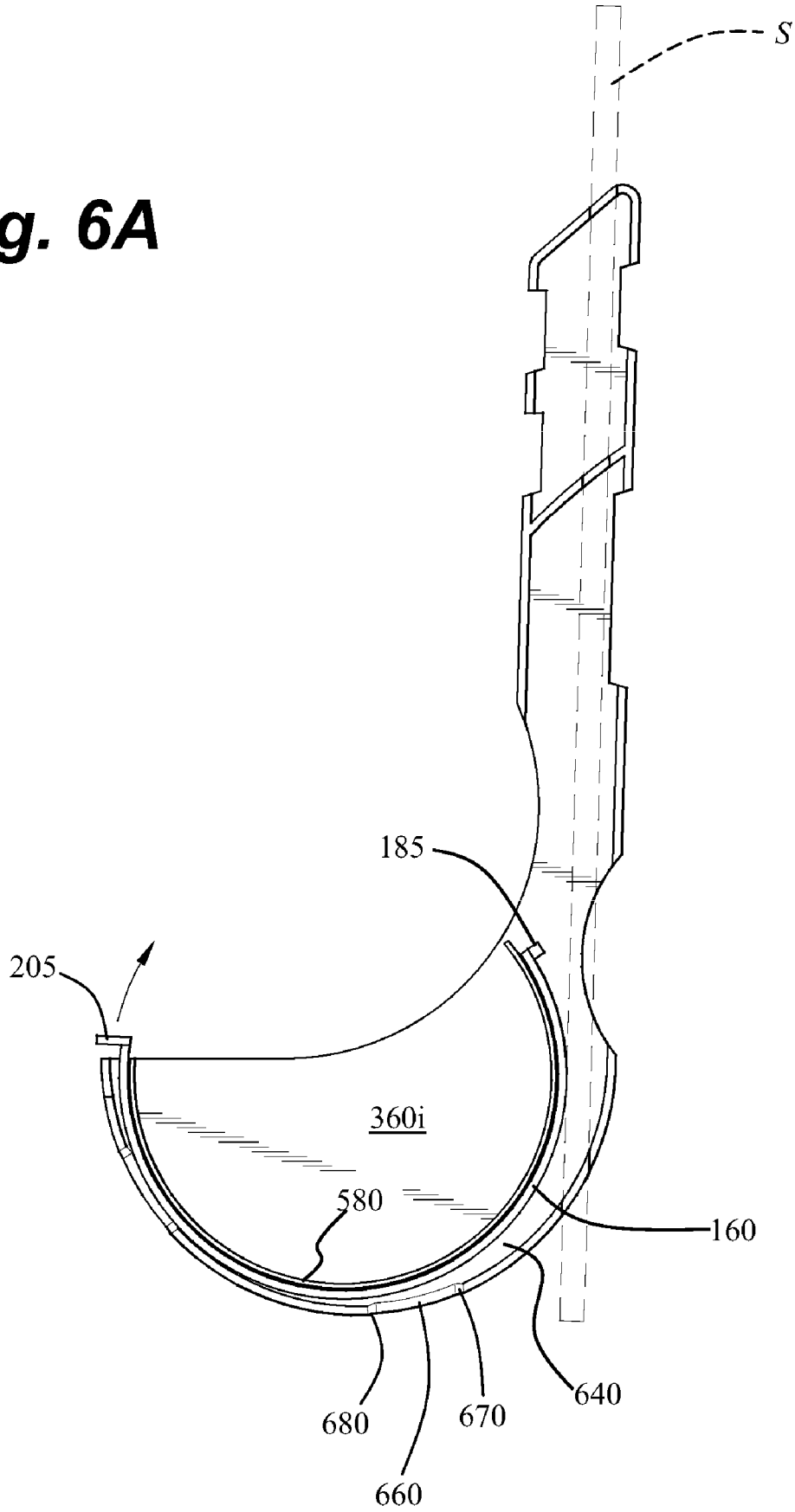
FIG. 6A shows the sip and dip cookie apparatus of FIG. 6 with a straw shown in outline.
Figure 6B:
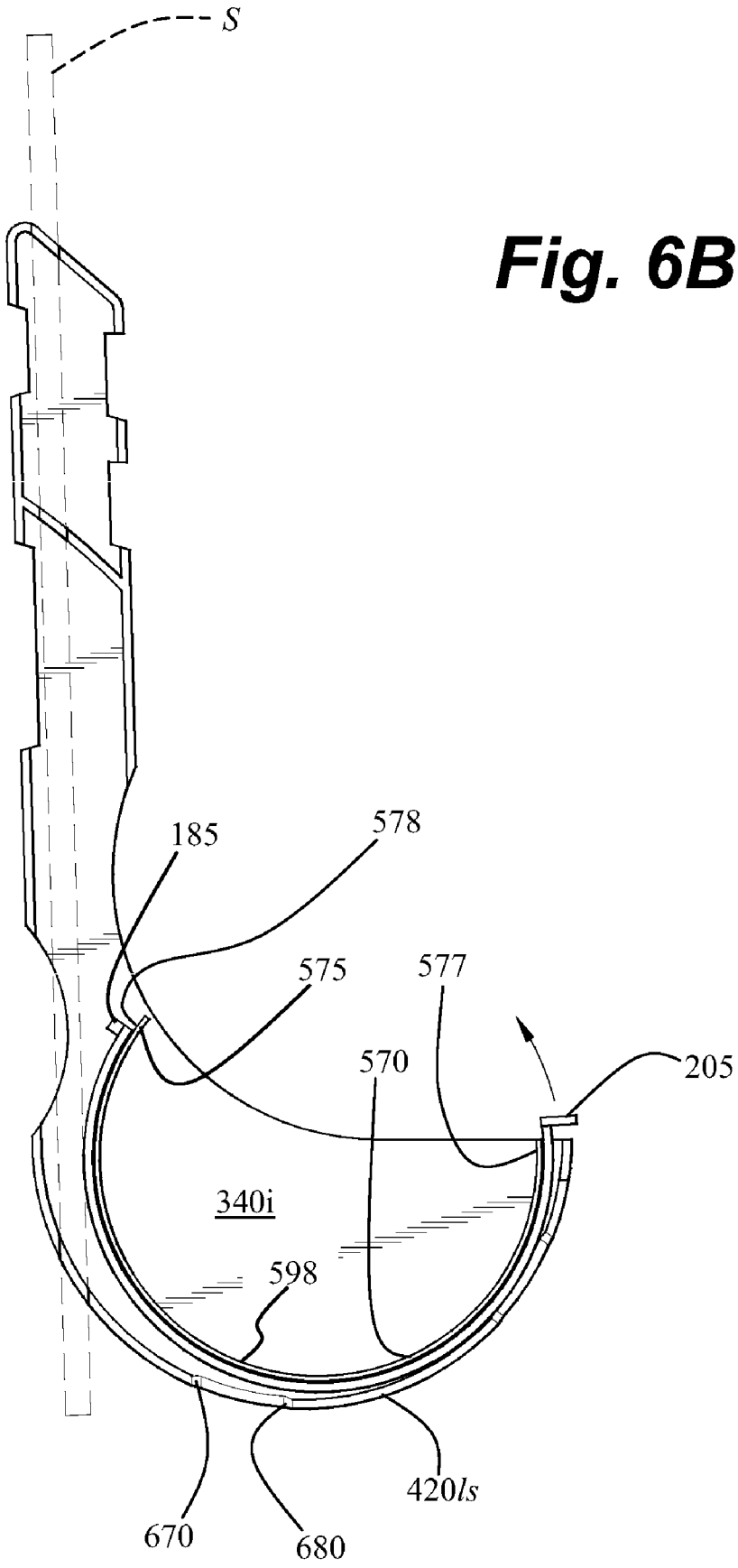
FIG. 6B shows a partially cutaway view of the sip and dip cookie apparatus with a cookie cover in a retracted position according to the present invention.
Figure 7:
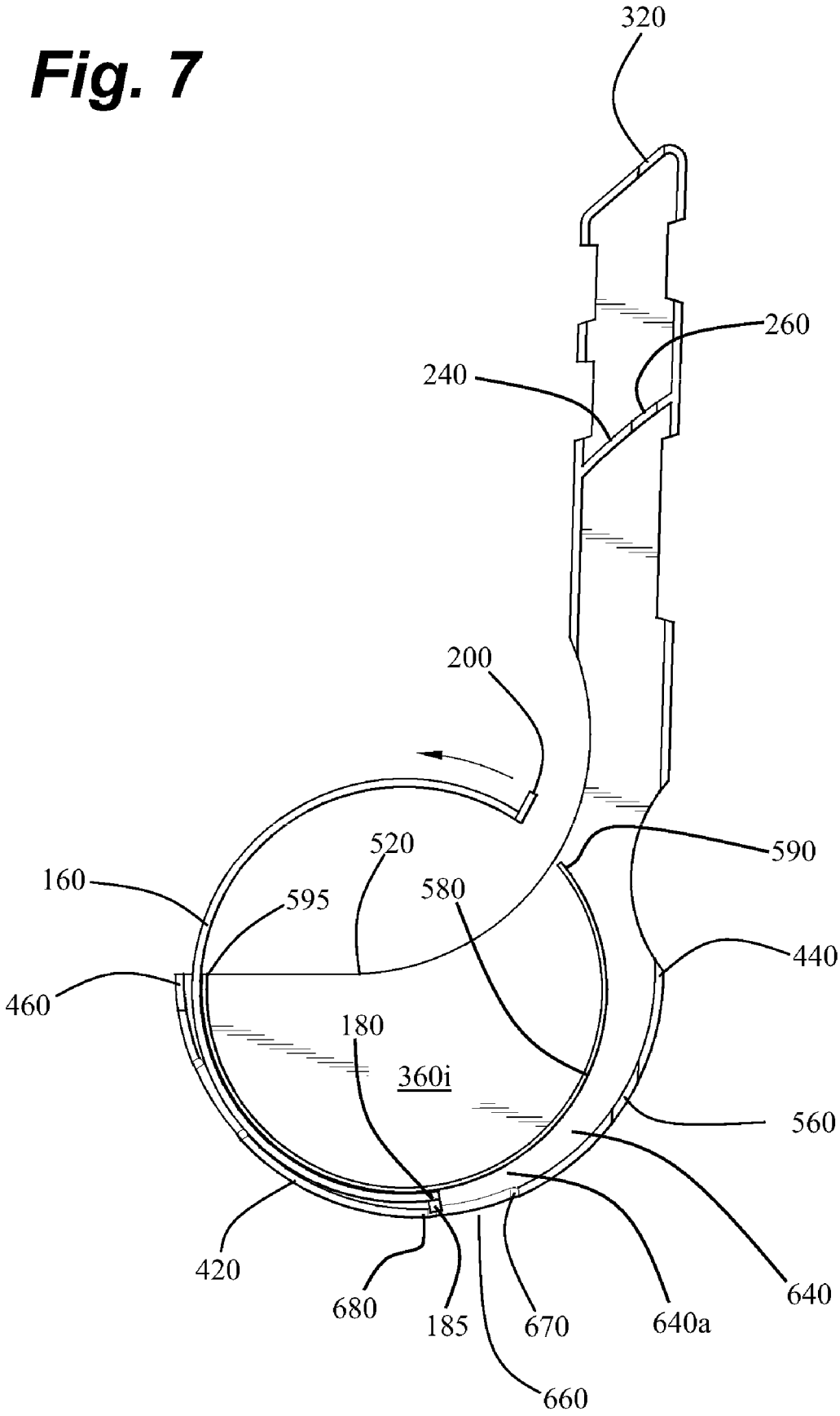
FIG. 7 shows a partially cutaway view of the sip and dip cookie apparatus with a cookie cover in a deployed (i.e., extracted) position.
Figure 8:
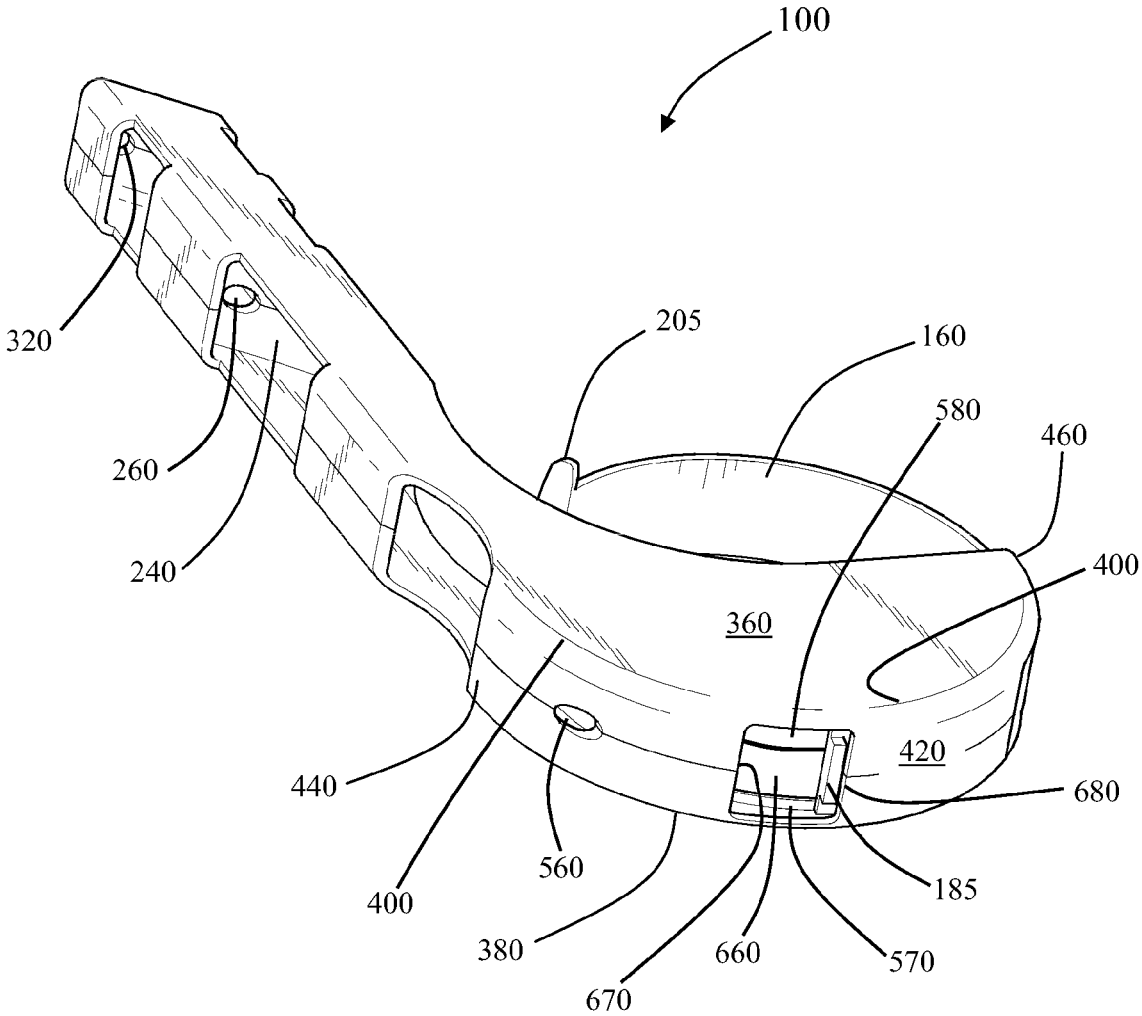
FIG. 8 shows a perspective bottom view of the sip and dip cookie apparatus shown in FIG. 1.

Referring to FIGS. 6 through 6B in combination with FIGS. 3A and 8, first and second sidewalls 340 and 360 respectively define first and second cookie guide members 570 and 580. First and second cookie guide members 570 and 580 are essentially mirror images of each other and respectively extend from the interior surfaces 340*i* and 360*i* of first and second sidewalls 340 and 360, respectively. First and second cookie guide members 570 and 580 being located proximate to first and second curved outer peripheries 380 and 400, respectively. An explanation of the part numbers shown in FIG. 6A is found in Table 1.

FIG. 6B shows a partially cutaway view of the left side of the sip and dip cookie apparatus 100 shown in FIG. 1. Of interest is a straw exit aperture 560 from which a straw S exits the sip and dip cookie apparatus 100. The apertures 320, 260 and 560 are in straight-line alignment such that a user (such as a child or adult) can push a straw through a top aperture 320 thence through straw guide aperture 260 and then through straw exit aperture 560 (shown, e.g., in FIG. 8).

First cookie guide member 570 defines opposite ends 575 and 577, and second cookie guide member 580 defines opposite ends 590 and 595. The first and second cookie guide members 570 and 580 acts as guides directing the extraction or retraction of the cookie cover 160. More specifically, first and second cookie guide members 570 and 580 enable a user to reversibly extract the cookie cover 160. It should be understood that the term "reversibly extract" is intended to mean the cookie cover 160 can be extracted to cover a cookie C and retracted to allow a user to place a cookie C between first and second sidewalls 340 and 360, which form part of the lower portion 140.

The rim 420 defines an internal rim surface 430. First and second cookie guide members 570 and 580 respectively define first and second lower guide surfaces 578 and 600. During normal use of the sip and dip cookie apparatus 100 at least a portion of the cookie cover 160 is located between the internal rim surface 430 and first and second lower guide surfaces 578 and 600. Thus, upon extracting or retracting the cookie cover 160 from the second void 480 of the lower portion 140 the cookie cover 160 slides between surfaces 578, 600 and 430.

First and second cookie guide members 570 and 580 respectively define first and second upper guide surfaces 598 and 620. During normal use of the sip and dip cookie apparatus 100 the cookie cover 160 is retracted into the lower portion 140 and a cookie C deposited in the second void 480 of the lower portion 140, whereupon the cookie C is supported by the upper guide surface 620. Upon placement of the cookie C into the second void 480 of the lower portion 140 the cookie cover 160 is extracted out of the lower portion 140 to cover cookie C. The sip and dip cookie apparatus 100 is then typically dunked into fresh milk with a straw fitted to the sip and dip cookie apparatus 100.

The first cookie guide member 570 is situated proximal to first curved outer periphery 380 and just above internal rim surface 430 of rim 420. The first cookie guide member 570 extends between opposite proximal and distal ends 440 and 460 of rim 420. The first cookie guide member 570 and internal rim surface 430 of rim 420 define a first cookie guide slot 630 therebetween (see FIG. 16). The first cookie guide slot 630 progressively narrows between opposite proximal and distal ends 440 and 460 of rim 420. More specifically, first cookie guide slot 630 is larger proximate to proximal end 440 than at distal end 460.

The second cookie guide member 580 is situated proximal to second curved outer periphery 400 and just above rim 420 and extends between opposite proximal and distal ends 440 and 460 of rim 420. The second cookie guide member 580 and rim 420 define a second cookie guide slot 640 therebetween. The second cookie guide slot 640 progressively narrows between opposite proximal and distal ends 440 and 460 of rim 420. More specifically, second cookie guide slot 640 is larger proximate to proximal end 440 than at distal end 460.

The first and second ends 180 and 200 of cookie cover 160 are respectively fashioned into a first protrusion 185 (see, e.g., FIG. 8) and a second protrusion 205 (see, e.g., FIGS. 3 and 3A). The first protrusion 185 helps prevent cookie cover 160 from inadvertently escaping from the lower portion 140. More specifically, the second cookie guide slot 640 narrows to the point where the first protrusion 185 prevents end 180 of cookie cover 160 from exiting the lower portion 140. Still more specifically, the second cookie guide slot 640 narrows to the point where the first protrusion 185 prevents end 180 of cookie cover 160 from exiting distal end 460 of rim 420. The second protrusion 205 prevents the end 200 of cookie cover 160 entering the distal end 460 of rim 420.

FIG. 8 shows a perspective bottom view of the sip and dip cookie apparatus shown in FIG. 1. The rim 420 defines a drain aperture 660 that allows milk to drain from the sip and dip cookie apparatus 100. The drain aperture 660 defines first and second opposite facing drain aperture sides 670 and 680, respectively. Opposite facing sides 670 and 680 are transverse with respect to the rim 420.

In one embodiment, the first protrusion 185 of cookie cover 160 is sized to fit inside drain aperture 660 and abut against second drain aperture side 680, wherein second drain aperture side 680 prevents cookie protrusion 185 proceeding beyond side 680 in the direction of distal end 460 of rim 420 thereby preventing the cookie cover 160 from inadvertently escaping from the lower portion 140.

In a preferred embodiment the second cookie guide slot 640 at side 680 is insufficient to allow first protrusion 185 at first end 180 to pass beyond second drain aperture side 680. An explanation of the part numbers shown in FIG. 8 is found in Table 1.

Figure 9:
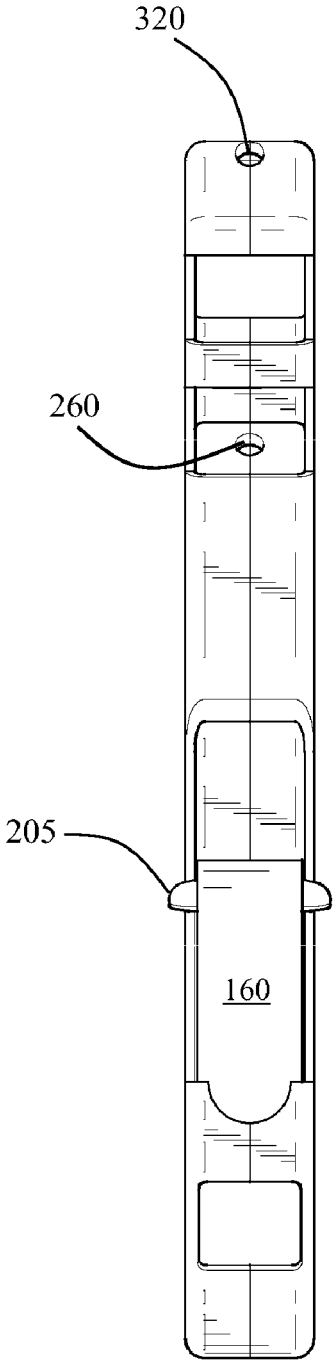
FIGS. 9 and 10 respectively show front and rear views of the sip and dip cookie apparatus shown in FIG. 1.
Figure 10:
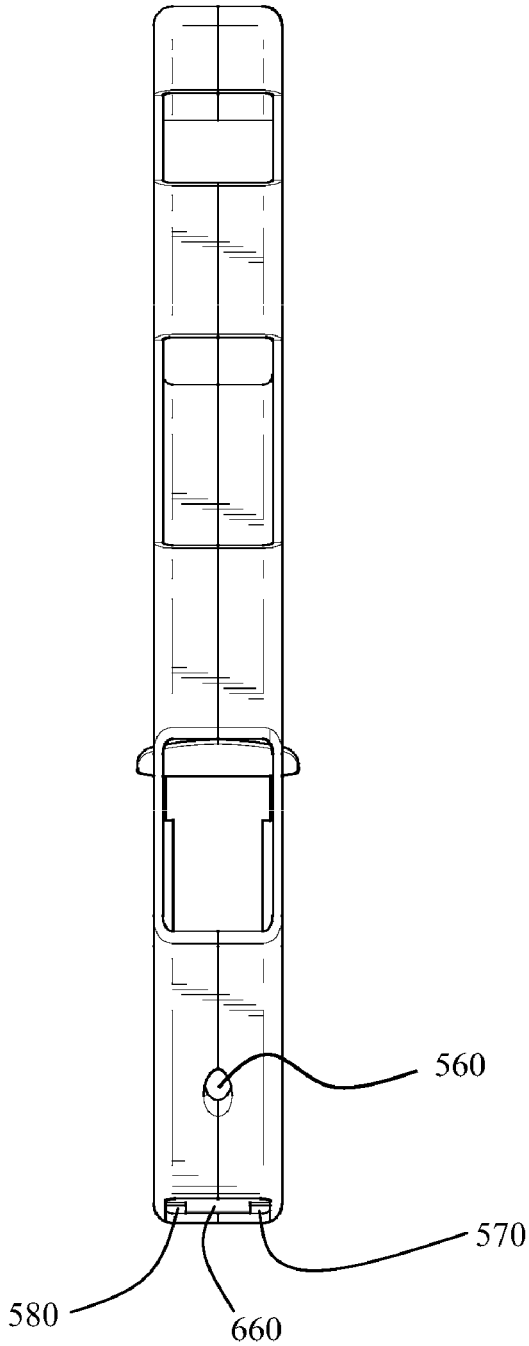

FIGS. 9 and 10 respectively show front and rear views of the sip and dip cookie apparatus shown in FIG. 1. An explanation of the part numbers shown in FIGS. 9 and 10 are found in Table 1.

Figure 11:
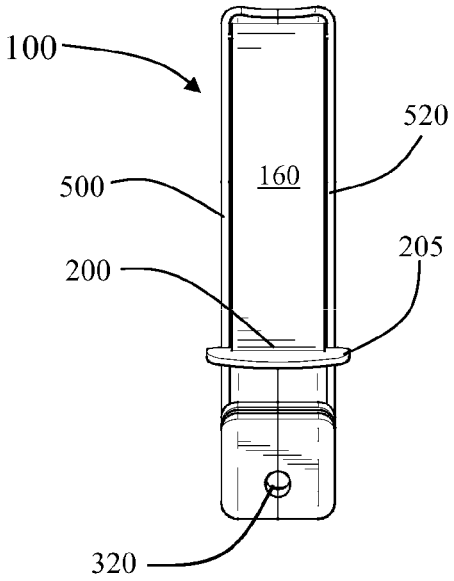
FIGS. 11 and 12 respectively show top and bottom views of the sip and dip cookie apparatus shown in FIG. 1.
Figure 12:
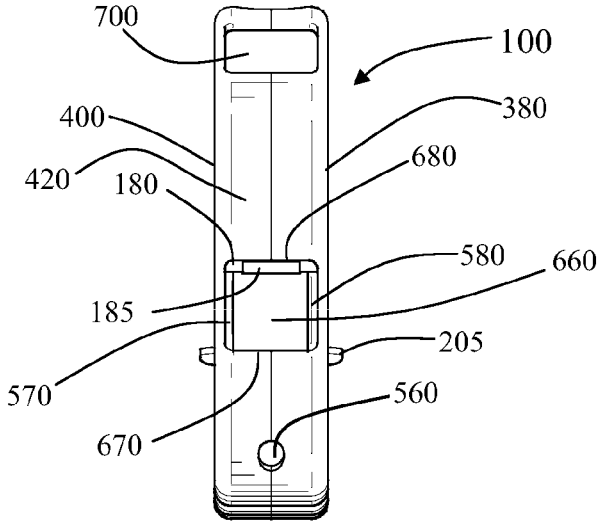

FIGS. 11 and 12 respectively show top and bottom views of the sip and dip cookie apparatus shown in FIG. 1. An explanation of the part numbers shown in FIGS. 11 and 12 are found in Table 1.

FIGS. 13A, 13B and 13C show Table 1.

Figure 14:
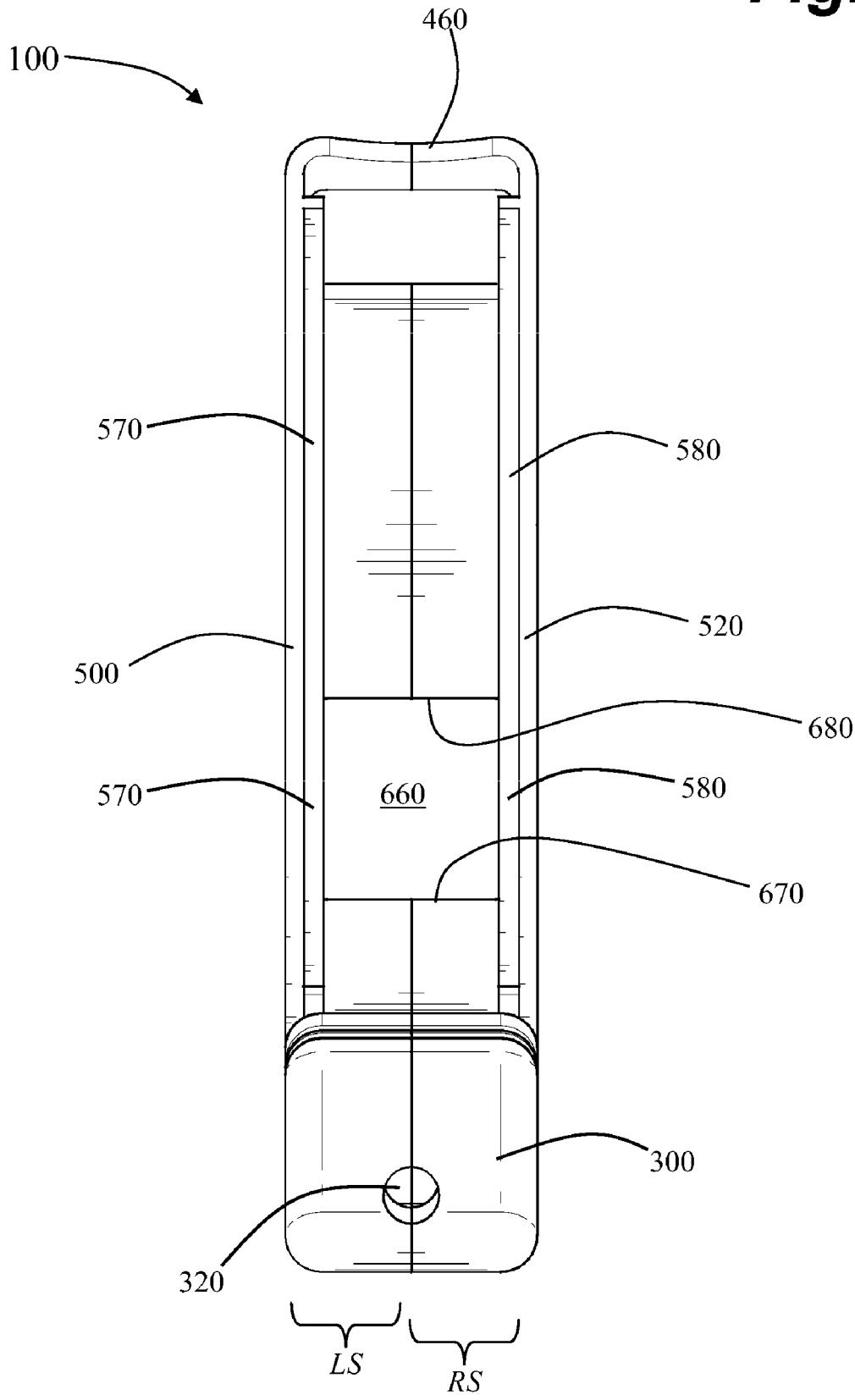
FIG. 14 shows a top view of the sip and dip cookie apparatus absent the cookie cover member to reveal the layout of the first and second cookie guide members.

FIG. 14 shows a top view of the sip and dip cookie apparatus absent the cookie cover member to reveal the layout of the first and second cookie guide members. An explanation of the part numbers shown in FIG. 14 is found in Table 1.

Figure 15:
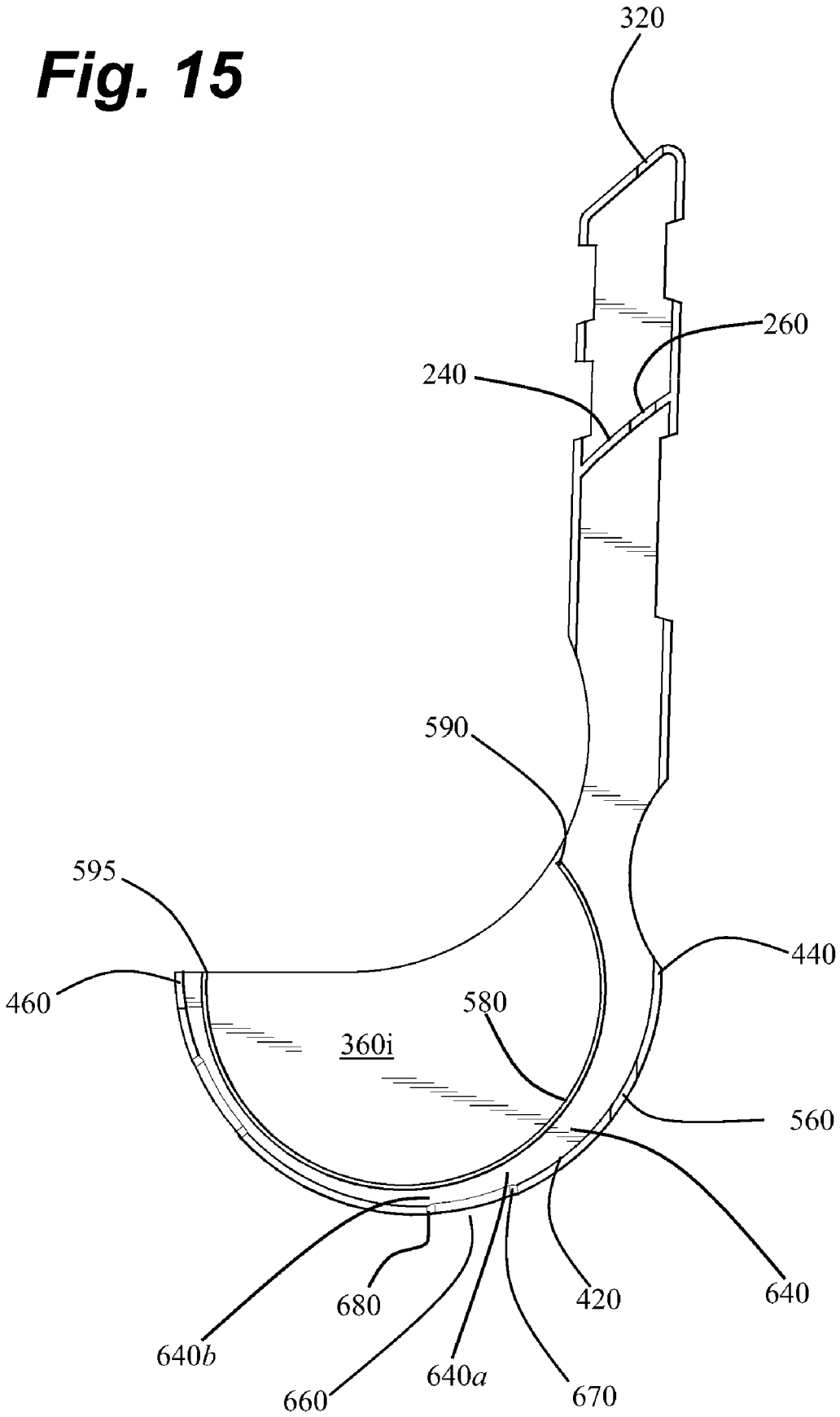
FIG. 15 shows a partially cutaway view of the sip and dip cookie apparatus, wherein for illustrative purposes the cookie cover member is not shown.

FIG. 15 shows a partially cutaway view of the sip and dip cookie apparatus, wherein for illustrative purposes the cookie cover member is not shown. An explanation of the part numbers shown in FIG. 15 is found in Table 1.

Figure 16:
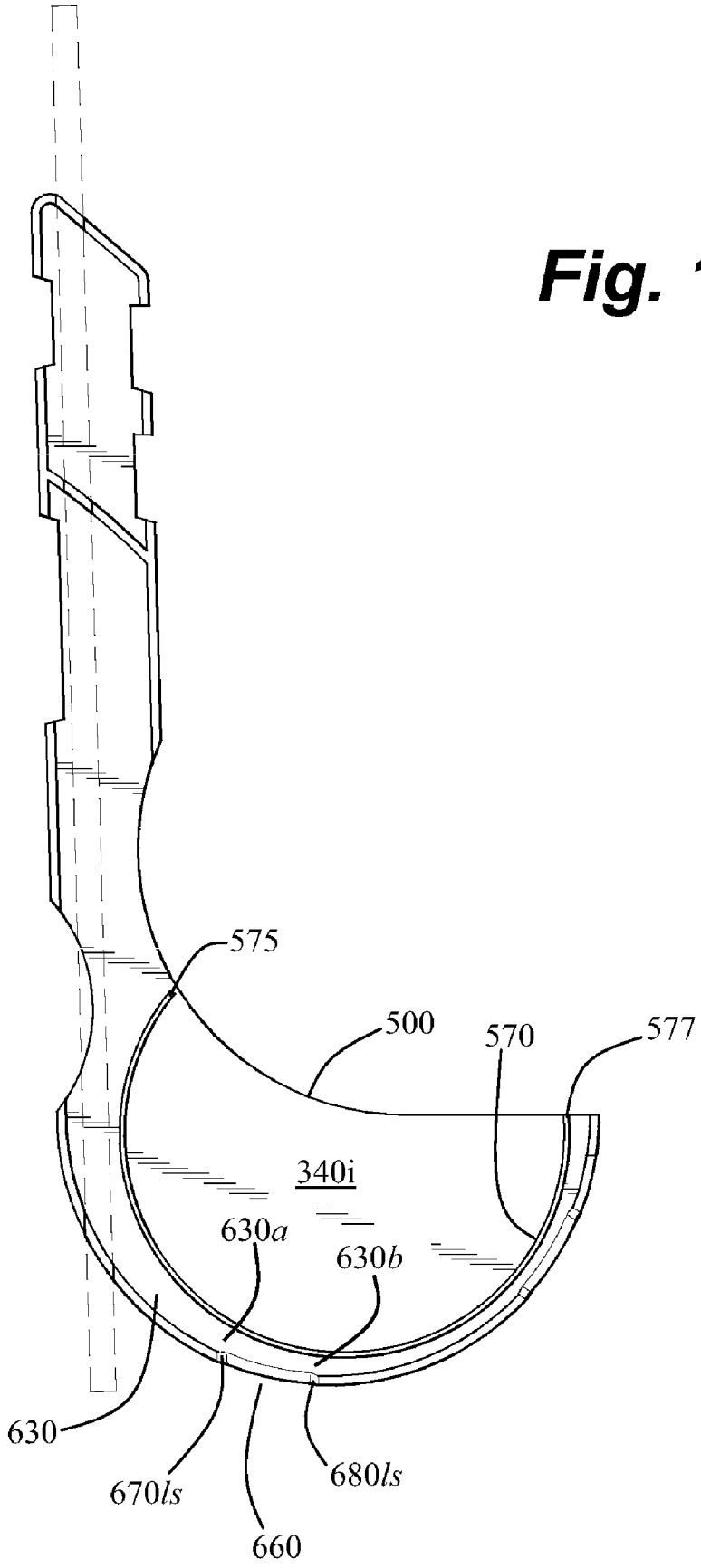
FIG. 16 shows a partially cutaway view of the sip and dip cookie apparatus, wherein for illustrative purposes the cookie cover member is not shown.

FIG. 16 shows a partially cutaway view of the sip and dip cookie apparatus, wherein for illustrative purposes the cookie cover member is not shown. An explanation of the part numbers shown in FIG. 16 is found in Table 1.

In one aspect of the invention the sip and dip cookie apparatus 100 comprises: an upper elongated portion 120 configured to hold a straw; a lower portion 140 configured to hold a cookie C, wherein the upper elongated portion 120 and lower portion 140 are integrally connected, and the lower portion 140 respectively defines top 300 and bottom 280 ends thereof; and a cookie cover 160, wherein the cookie cover 160 has a generally flat and elongated curved shape having opposite first 180 and second 200 ends, respectively. The lower portion 140 comprises first 340 and second 360 opposite facing sidewalls of generally semicircular appearance. The first and second opposite facing sidewalls 340 and 360 respectively define first and second upper sidewall edges 500 and 520 and further respectively defines first 380 and second 400 curved outer peripheries with a rim 420 therebetween, the rim 420 defining left 420*ls* and right 420*rs* longitudinal sides of the rim 420, wherein the rim 420 further defines proximal 440 and distal 460 ends of the rim 420, wherein the first 500 and second 520 upper sidewall edges define a cookie access aperture 540 therebetween for receiving therethrough a cookie C, wherein the first 340 and second 360 opposite facing sidewalls respectively define first 570 and second 580 cookie guide members, wherein the first 570 and second 580 cookie guide members and the left 420*ls* and right 420*rs* longitudinal sides of the rim 420 respectively define first 630 and second 640 cookie guide slots, wherein the first 630 and second 640 cookie guide slots extend and progressively narrow between the proximal 440 and distal 460 ends of the rim, wherein the proximal 440 end of the rim 420 is located proximal to the bottom end 280 of the upper portion 120, whereby the narrowing of the first 630 and second 640 cookie guide slots prevents the cookie cover 160 from exiting the distal end 460 of the rim 420.

In one aspect of the invention the first 180 and second 200 ends of the cookie cover 160 respectively define first 185 and second 205 protrusions, wherein the rim 420 defines a drain aperture 660 having first 670 and second 680 opposite facing drain aperture sides, wherein the first 670 and second 680 opposite facing drain aperture sides are transverse with respect to the rim 420, wherein the second drain aperture side 680 is closer than the first drain aperture side 670 to the distal end 460 of the rim 420, whereby upon extraction of the cookie cover 160 the first protrusion 185 abuts against the second drain aperture side 680.

It is to be understood that the present invention is not limited to the embodiments described above, but encompasses any and all embodiments within the scope of the following claims.

I claim:

1. A sip and dip cookie apparatus, comprising:

an upper elongated portion configured to hold a straw;

a lower portion configured to hold a cookie, wherein the upper elongated portion and lower portion are integrally connected, and said lower portion defines top and bottom ends thereof; and a cookie cover, wherein the cookie cover has a generally flat and elongated curved shape having opposite first and second ends, respectively, wherein said lower portion comprises first and second opposite facing sidewalls of generally semicircular appearance, said first and second opposite facing sidewalls respectively define first and second upper sidewall edges and further respectively defining first and second curved outer peripheries with a rim therebetween, said rim defining left and right sides of said rim, wherein said rim further defines proximal and distal ends of said rim, said first and second upper sidewall edges define a cookie access aperture therebetween for receiving therethrough a cookie, wherein said first and second opposite facing sidewalls respectively define first and second cookie guide members, wherein said first and second cookie guide members and said left and right sides of said rim respectively define first and second cookie guide slots, wherein said first and second cookie guide slots extend and progressively narrow between said proximal and distal ends of said rim, wherein said proximal end of said rim is located proximal to said bottom end of said upper portion, whereby the narrowing of said first and second cookie guide slots prevents said cookie cover from exiting said distal end of said rim.

2. The sip and dip cookie apparatus of claim 1, wherein said first and second ends of said cookie cover respectively define first and second protrusions, wherein said rim defines a drain aperture having first and second opposite facing drain aperture sides, wherein said first and second opposite facing drain aperture sides are transverse with respect to said rim, wherein said second drain aperture side is closer than said first drain aperture side to said distal end of said rim, whereby upon extraction of said cookie cover said first protrusion abuts against said second drain aperture side.

* * * * *